US010544006B2

(12) United States Patent
Forrest et al.

(10) Patent No.: US 10,544,006 B2
(45) Date of Patent: Jan. 28, 2020

(54) PAPER ROLL SPINDLE ASSEMBLIES, SUPPORT ASSEMBLIES AND PACKAGING

(71) Applicant: LIBERTY HARDWARE MFG. CORP., Winston-Salem, NC (US)

(72) Inventors: Earl David Forrest, Asheboro, NC (US); Christine Lemnios, Greensboro, NC (US); Ryan Patrick Martin, Kernersville, NC (US)

(73) Assignee: LIBERTY HARDWARE MFG. CORP., Wintston-Salem, NC (US)

( * ) Notice: Subject to any disclaimer, the term of this patent is extended or adjusted under 35 U.S.C. 154(b) by 706 days.

(21) Appl. No.: 15/079,552

(22) Filed: Mar. 24, 2016

(65) Prior Publication Data

US 2017/0275132 A1 Sep. 28, 2017

(51) Int. Cl.
*B65H 75/22* (2006.01)
*B65D 85/672* (2006.01)
*B65D 75/00* (2006.01)

(52) U.S. Cl.
CPC ..... *B65H 75/22* (2013.01); *B65D 75/002* (2013.01); *B65D 85/672* (2013.01)

(58) Field of Classification Search
USPC ..... 242/599.1, 599.2, 599; 206/756, 576, 206/320, 389, 485, 493, 825
See application file for complete search history.

(56) References Cited

U.S. PATENT DOCUMENTS

| | | | | |
|---|---|---|---|---|
| 1,045,311 | A | 11/1912 | Moberg | |
| 2,114,008 | A | 4/1938 | Wunderlich | |
| 2,308,713 | A | 1/1943 | Price | |
| 2,685,397 | A * | 8/1954 | Ellswood | A47G 19/24 206/446 |
| 3,304,034 | A * | 2/1967 | Jones | A47K 10/38 206/408 |
| 3,827,210 | A | 8/1974 | Smalley et al. | |
| 5,340,047 | A | 8/1994 | Heller | |
| 5,439,521 | A * | 8/1995 | Rao | A47K 10/3827 118/415 |
| 6,889,398 | B2 | 5/2005 | Lewis | |
| 6,969,024 | B2 | 11/2005 | He et al. | |
| 7,048,225 | B2 * | 5/2006 | Delfino | A47K 10/40 206/229 |
| 7,311,286 | B2 | 12/2007 | Burnett | |

(Continued)

*Primary Examiner* — Jacob K Ackun
(74) *Attorney, Agent, or Firm* — Brooks Kushman P.C.; Lora Graentzdoerffer

(57) ABSTRACT

A paper roll support assembly is provided with a collapsible spindle with distal ends to be received in a pair of bracket receptacles. Product packaging is sized to receive the collapsible spindle only in a collapsed state of the spindle to minimize an overall size. The collapsible spindle is provided with an outer spindle member, an open end spaced apart from the distal end, and a cavity formed therein with a first diameter. An inner spindle member is provided with a proximal end spaced apart from the distal end with an outer diameter sized to be received within the cavity for translation and rotation relative to the outer spindle. A first retainer is oriented in the cavity in cooperation with a second retainer oriented on the inner spindle member such that extension is prevented in a first rotational orientation and extension is permitted in a second rotational orientation.

14 Claims, 7 Drawing Sheets

(56) References Cited

U.S. PATENT DOCUMENTS

| | | | | |
|---|---|---|---|---|
| 2002/0134881 | A1* | 9/2002 | Hoernig | A47K 10/40 242/599.1 |
| 2009/0057169 | A1* | 3/2009 | Kruchoski | A47K 10/40 206/225 |
| 2012/0211587 | A1* | 8/2012 | Caldwell | B65H 49/26 242/599.1 |
| 2014/0284236 | A1* | 9/2014 | Kuebart | B65D 21/023 206/408 |

* cited by examiner

PAPER ROLL SPINDLE ASSEMBLIES, SUPPORT ASSEMBLIES AND PACKAGING

TECHNICAL FIELD

Various embodiments relate to paper roll spindle assemblies, paper roll support assemblies, and packaging for paper roll support assemblies.

BACKGROUND

Conventional paper roll support assemblies are typically packaged, shipped and retailed in a fully assembled state.

SUMMARY

According to at least one embodiment, a packaged paper roll support assembly is provided with a collapsible spindle with a pair of distal ends sized to be received in a pair of bracket receptacles to support a paper roll on the spindle. Product packaging is sized to receive the collapsible spindle only in a collapsed state of the collapsible spindle to retain the spindle in the collapsed state to minimize an overall size of the product packaging.

According to at least another embodiment, a paper roll spindle assembly is provided with an outer spindle member with a distal end, an open end spaced apart from the distal end, and a cavity formed within the outer spindle member with a first diameter. A first retainer is oriented within the cavity. An inner spindle member is provided with a distal end, and a proximal end spaced apart from the distal end with an outer diameter sized to be received within the cavity for translation and rotation relative to the outer spindle. A second retainer is oriented on the inner spindle member in cooperation with the first retainer such that extension of the inner spindle member relative to the outer spindle is prevented in a first rotational orientation of the inner spindle member relative to the outer spindle member and extension of the inner spindle member relative to the outer spindle member is permitted in a second rotational orientation of the inner spindle member relative to the outer spindle member.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Product packaging and transportation costs can have dramatic negative effects on the cost of goods sold. In the case of overseas transportation costs, which are closely tied to the cost of crude oil, the burden can range from ten to eighteen percent of total product cost. The cost of shipping products within an overseas container is a function of both weight and volume. Products, such as spring-loaded toilet paper holder assemblies are often retail packaged in a fully assembled state with the decorative support posts. These retail packages typically contain clear viewing window(s) within at least one panel so consumers can view the product within the packaging before they make a purchasing decision. This common form of packaging results in what is termed as "shipping air", which simply references that an associated overseas shipping container will be completely filled with product long before a maximum weight capacity of the shipping container is reached.

Packaging costs for spring-loaded toilet paper holder assemblies is often determined by a flat pattern size of both a retail carton and a shipping carton in conjunction with a total quantity of print colors and fold complexity which has an effect on assembly time. Reduction of the size of the packaging in more than one direction can provide significant cost savings due to more efficient use of packaging materials, as well as more efficient use of storage space in shipping containers, warehouse and store shelves alike.

Figure 1:
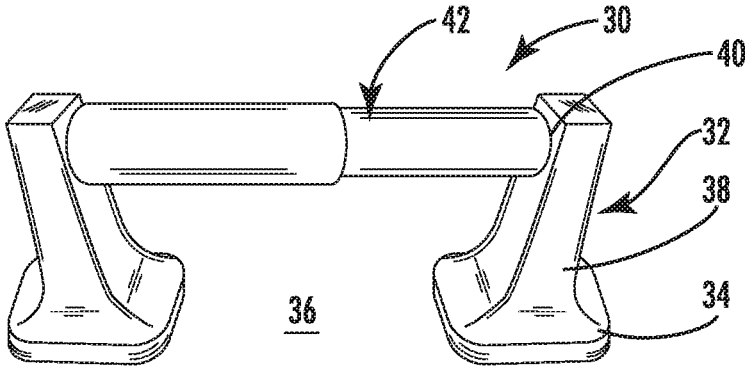
FIG. 1 is a top perspective view of an assembled paper roll support assembly, according to an embodiment.

Referring now to FIG. 1, a paper roll support assembly is depicted according to an embodiment, and illustrated assembled and referenced generally by numeral 30. The paper roll support assembly 30 includes a pair of brackets 32. Each bracket 32 includes a base 34 that is adapted to be mounted to a support surface, such as wall 36 by hardware, as is known in the art. A post 38 extends from each base 34, and is provided with a receptacle 40. The brackets 32 are installed upon the wall 36 such that the receptacles 40 face centrally inward.

A collapsible spring-loaded spindle assembly 42 is supported in the receptacles 40 of the brackets 32. Expansion of the spindle assembly 42 engages the receptacles 40 and maintains the paper roll support assembly 30 in an assembled condition. Manual collapsing of the spindle assembly 42 permits removal of the spindle assembly 42 for insertion within a paper roll, such as a toiler paper roll. Subsequent collapsing of the spindle assembly 42 permits installation of the spindle assembly into the brackets 32. Spring-loaded expansion of the spindle assembly 42 reengages the receptacles 40 to support the paper roll between the brackets 32.

Figure 2:
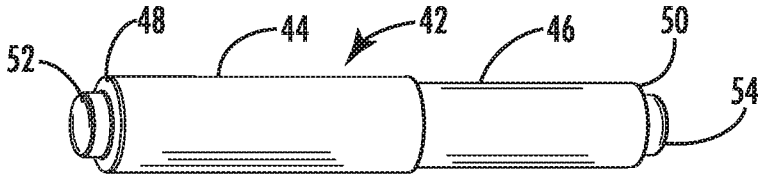
FIG. 2 is a side view of a spindle assembly of the paper roll support assembly of FIG. 1.

The spindle assembly 42 is illustrated in FIG. 2, disassembled from the brackets 32. The spindle assembly 42 includes an outer spindle member 44 in the form of a hollow sleeve. The spindle assembly 42 also includes an inner spindle member 46 in the form of a hollow sleeve with an outer diameter sized to be received within an inner diameter of the outer spindle member 44. The outer spindle member 44 and the inner spindle member 46 each include a distal end 48, 50 that is partially capped to provide a blind internal depth. A coil expansion spring (not shown) is oriented within the outer spindle member 44 and the inner spindle member 46 and engages the blind depths to provide expansion of the spindle assembly 42 by biasing the outer and inner spindle members 44, 46 away from each other. A trunnion 52, 54 extends from each distal end 48, 50 and is sized to be received in the corresponding receptacle 40 of one of the brackets 32.

Figure 3:
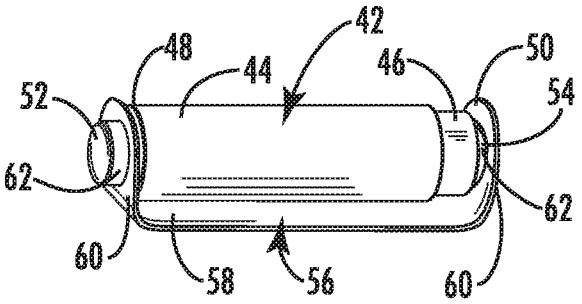
FIG. 3 is a side perspective view of the spindle assembly of FIG. 2, illustrated partially packaged according to an embodiment.

FIG. 3 illustrates the spindle assembly 42 partially packaged according to an embodiment. In FIG. 3, the spindle assembly 42 is compressed, and contained within a stamped polymeric sheet 56. The polymeric sheet 56 includes a base 58 sized to match the collapsed state of the spindle assembly 42. A pair of tabs 60 extend from the base 58 and each provide an aperture 62 to receive one of the trunnions 52, 54 of the spindle assembly 42. One trunnion 52 or 54 of the spindle assembly 42 is inserted through one aperture 62 of the polymeric sheet 56. The spindle assembly 42 is then compressed and the opposing tab 60 of the sheet 56 is wrapped over the other trunnion 52 or 54 of the spindle assembly 42.

Figure 4:
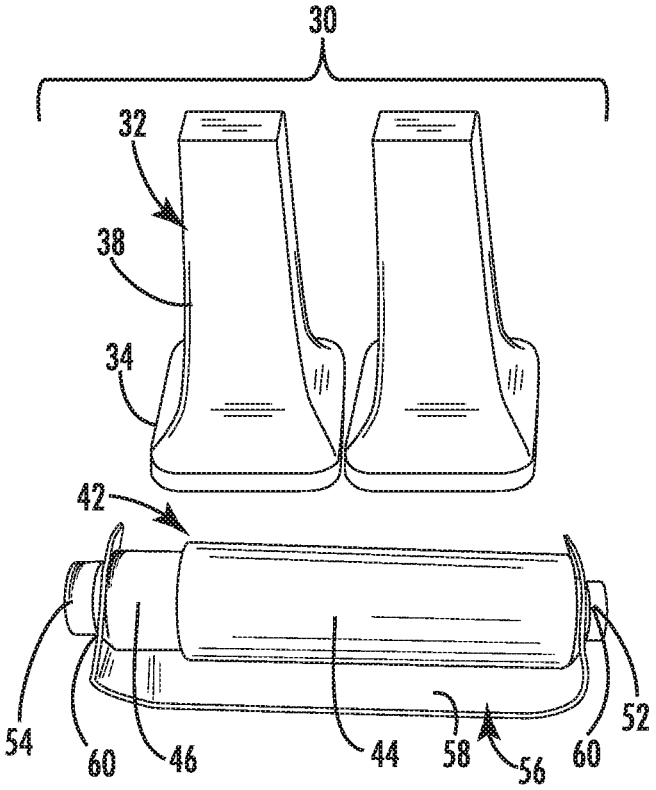
FIG. 4 is a top perspective view of the paper roll support assembly of FIG. 1, illustrated partially packaged according to an embodiment.
Figure 5:
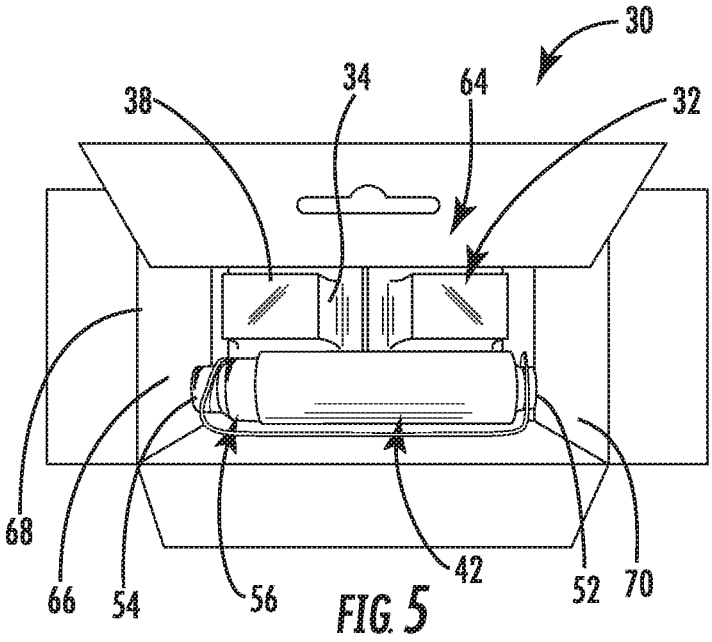
FIG. 5 is a top perspective view of the paper roll support assembly of FIG. 1, illustrated partially packaged according to another embodiment.

FIG. 4 illustrates the paper roll support assembly 30 with the collapsed spindle assembly 42 to demonstrate the reduction in volume when disassembled and collapsed. FIG. 5 depicts an example with product packaging, or a cardboard box 64, in an open orientation with the brackets 32 and the collapsed spindle assembly 42 retained within a cavity 66 in the cardboard box 64. The cardboard box 64 is formed from a series of panels, including two spaced apart side panels 68, 70 that are sized to receive the collapsed spindle assembly 42. The polymeric sheet 56 receives the tensile load from the compressed spindle assembly 42 to prevent distributing the load to the box 64, which may result in bulging or the like. The box 64 may be relatively thin with a wall thickness between within a range of one half to one millimeter.

The packaging of the paper roll support assembly 30 in a disassembled or nested state optimizes a smaller volumetric foot print. This approach permits economically transporting and storing the spring-loaded spindle assembly 42 in a fully compressed state. This embodiment offers reduced transportation and packaging costs realized from using significantly less packaging materials while also utilizing less space during transport, warehousing, and retail.

Spring-loaded spindle assemblies 42 are generally designed with an internal coil spring. Additional features of these highly commoditized devices typically also include integral stops which prevent the unit from inadvertent disassembly. Conventional residential paper roll support assemblies, such as toilet paper roll support assemblies, are packaged and shipped with the spindle assembly in the expanded or relaxed state, wherein the overall length of the spindle assembly is typically six inches. This relaxed state dimension places a restriction onto the overall length of the packaging for toilet paper holder assemblies to a minimum of six inches. By compressing the spindle assembly 42, and then retaining the spindle assembly 42 compressed while packaged, the overall length can be reduced from six inches to four inches for a reduction of thirty-three percent.

One example of a fully assembled toilet paper holder is fitted into a retail package that measures 7.50 inches by 3.37 inches by 2.13 inches. By compressing the spindle assembly 42, this same product can be nested into a box that measures 4.37 inches by 3.37 inches by 2.56 inches. This change represents a 29.7% reduction in the retail package volume and with an elimination of inner product protection flaps the material to manufacture the retail carton decreases by 71.6% based on total area of the die-cut box.

Toilet paper roll support assemblies are typically retailed in a fully assembled state. This retail approach provides the consumer the opportunity to view the product through an opening in the retail package before making their purchase. The deficiency in using this approach is that it is wasteful in both packaging materials and the space requirements to ship and store the product. Nesting the disassembled components of the paper roll support assembly 30 into an optimally sized retail box 64 allows the two posts 38 to be placed side by side with sufficient space between them to install a mounting hardware bag (not shown). The mounting hardware bag contains the hardware and separates the posts 38 during transportation to minimize damage therebetween.

Figure 6:
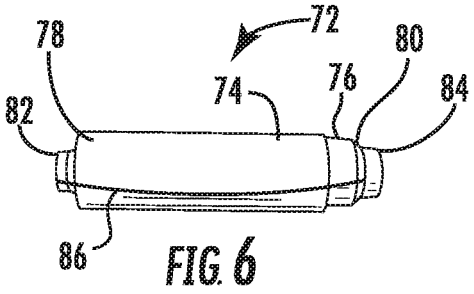
FIG. 6 is a side perspective view of the spindle assembly of FIG. 2, illustrated partially packaged according to another embodiment.

FIG. 6 illustrates a collapsible spindle assembly 72 according to another embodiment. Similar to the prior embodiment, the spindle assembly 72 includes an outer spindle member 74 over and inner spindle member 76. Distal ends 78, 80 of the spindle members 74, 76 are provided with trunnions 82, 84 respectively. An aperture may be formed through the trunnions 82, 84 to receive a wire tie 86 to retain and package the spindle assembly 72 in the compressed state. The wire tie 86 extends through a center of the spindle assembly 72 in the compressed state. The end user may cut the wire tie 86 and remove it from the spindle assembly 72. According to another embodiment, the wire tie 86 may be looped around the trunnions 82, 84 to compress the spindle assembly 72.

Figure 7:
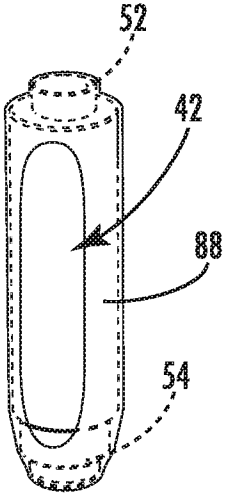
FIG. 7 is a side perspective view of the spindle assembly of FIG. 2, illustrated partially packaged according to another embodiment.

FIG. 7 illustrates the collapsible spindle assembly 42 prepackaged according to another embodiment. A heat shrinkable sleeve 88 is disposed over the spindle assembly 42 to retain and package the spindle assembly 42 in the compressed state. The spindle assembly 42 is first compressed and held while the sleeve 88 is slid over both trunnion ends 52, 54. Once the sleeve 88 is in place, heat is applied to the sleeve 88 to shrink the sleeve 88 and to retain the spindle assembly 42 in the compressed state.

Figure 8:
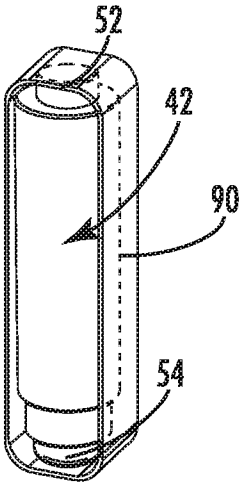
FIG. 8 is a side perspective view of the spindle assembly of FIG. 2, illustrated partially packaged according to another embodiment.

FIG. 8 illustrates the collapsible spindle assembly 42 prepackaged according to another embodiment. A polymeric sleeve 90 is disposed over the spindle assembly 42 to retain and package the spindle assembly 42 in the compressed state. The sleeve 90 is formed from a linear low-density polyethylene (LLDPE) material of sufficient thickness and material properties so that the sleeve 90 does not significantly creep or cold form during transportation and storage under the load of the spring-loaded spindle assembly 42.

Figure 9:
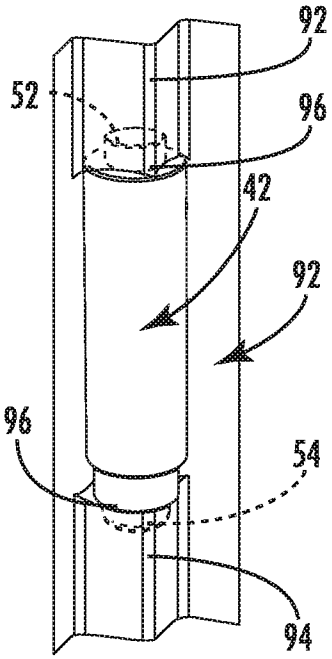
FIG. 9 is a side perspective view of the spindle assembly of FIG. 2, illustrated partially packaged according to another embodiment.

FIG. 9 depicts the spindle assembly 42 partially packaged according to another embodiment. The spindle assembly 42 is illustrated with a box 92 with an inverted corner 94 to provide a pair of receptacles 96 that are spaced apart to receive the trunnions 52, 54 of the spindle assembly 42 in the compressed state. A force of the spring in the fully compressed state can be as much as 5.3 pounds. The box 92 may be formed with a sufficient corrugate thickness to support and retain the compressed spindle assembly 42.

Figure 10:
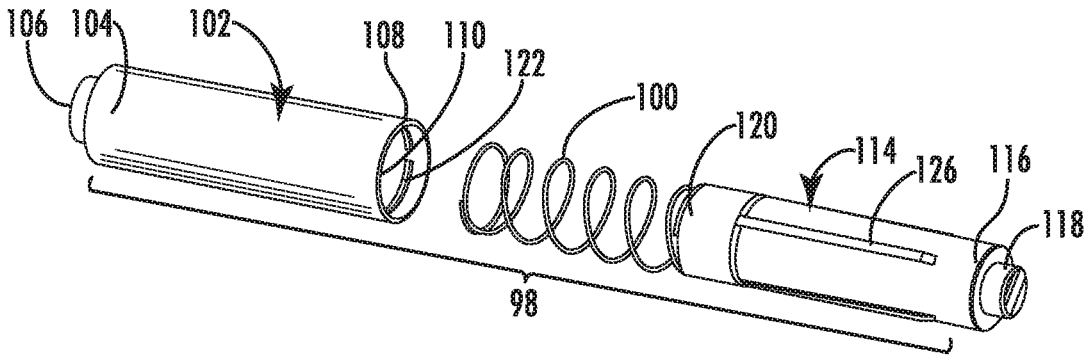
FIG. 10 is an exploded perspective view of a spindle assembly according to another embodiment.
Figure 11:
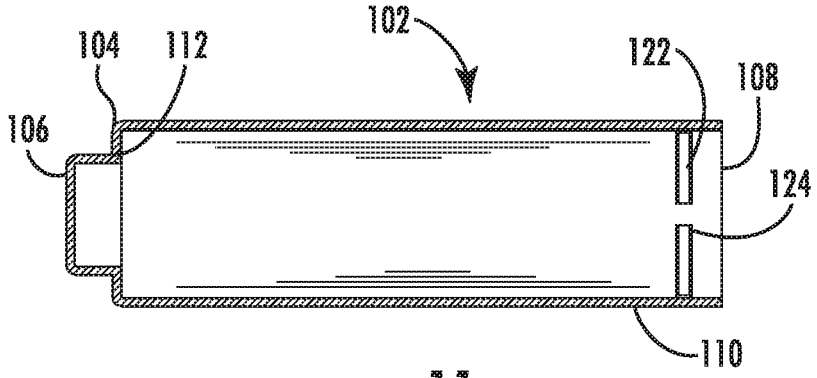
FIG. 11 is a cross section view of an outer spindle member of the spindle assembly of FIG. 10.
Figure 12:
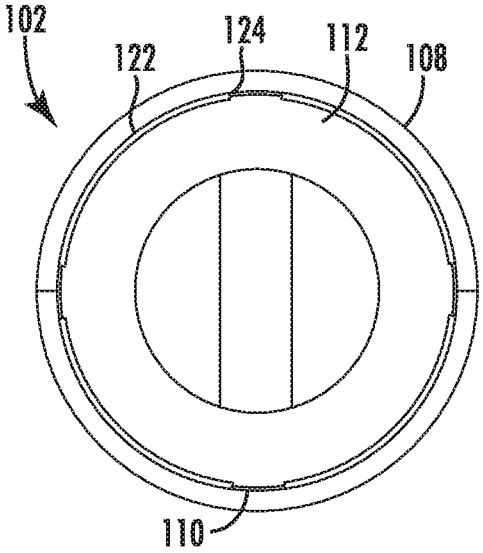
FIG. 12 is an axial end view of the outer spindle member of FIG. 11.

FIG. 10 illustrates a collapsible spindle assembly 98 according to another embodiment. The spindle assembly 98 is self-contained for retaining an internal coil spring 100 without requiring additional packaging. The spindle assembly 98 includes an outer spindle member 102, which is also illustrated in FIGS. 11 and 12. The outer spindle member 102 has a distal end 104 with a trunnion 106. The outer spindle member 102 has an open end 108 that is spaced apart from the distal end 104 for providing access to a cavity 110. The open end 108 and the cavity 110 have an inner diameter that extends to a blind depth 112 at the distal end 104 for receipt of the coil spring 100.

Referring again to FIG. 10, the collapsible spindle assembly 98 also includes an inner spindle member 114 with a distal end 116 and a trunnion 118 on the distal end 116. A proximal end 120 of the inner spindle member 114 is spaced apart from the distal end 116. The proximal end 120 has an outer diameter that is enlarged relative the remainder of the inner spindle member 114 and sized to engage the coil spring 100. The diameter of the proximal end 120 is also sized to be received within the cavity 110 of the outer spindle member 102 to retain the coil spring 100 within the cavity 110.

Figure 13:
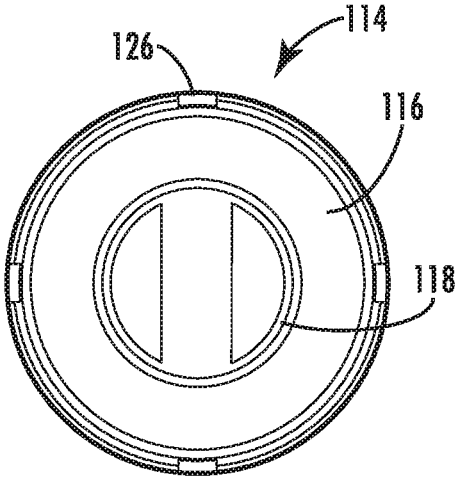
FIG. 13 is an axial end view of an inner spindle member of the spindle assembly of FIG. 10.

Referring now to FIGS. 10, 11 and 12, an annular array of retainer segments 122 are provided in the cavity 110 of the outer spindle member 102 proximate to the open end 108. The retainer segments 122 are spaced apart radially to provide a series of gaps 124, such as four gaps 124 with four segments 122. FIGS. 10 and 13 illustrate that a complementary array of longitudinal segments 126 are formed on the inner spindle member 114. The longitudinal segments 126 are spaced radially into quadrants to align with the gaps 124 in the annular retainer segments 122 of the outer spindle member 102. The longitudinal segments 126 each have a width sized to pass through one of the gaps 124.

With reference again to FIG. 10, during assembly of the spindle assembly 98, the coil spring 100 is inserted into the cavity 110 of the outer spindle member 102. Next, the proximal end 120 of the inner spindle member 114 is inserted into the open end 108 of the outer spindle member 102. The proximal end 120 of the inner spindle member 114 is forced beyond the annular retainer segments 122 under elastic deformation of the inner spindle member 114 and the outer spindle member 102, while also aligning the longitudinal segments 126 with the gaps in the annular retainer segments 122. Once the proximal end 120 of the inner spindle member 114 clears the annular retainer segments 122, the spindle assembly 98 is translatable from the compressed to uncompressed positions by compression of the coil spring 100.

Figure 14:
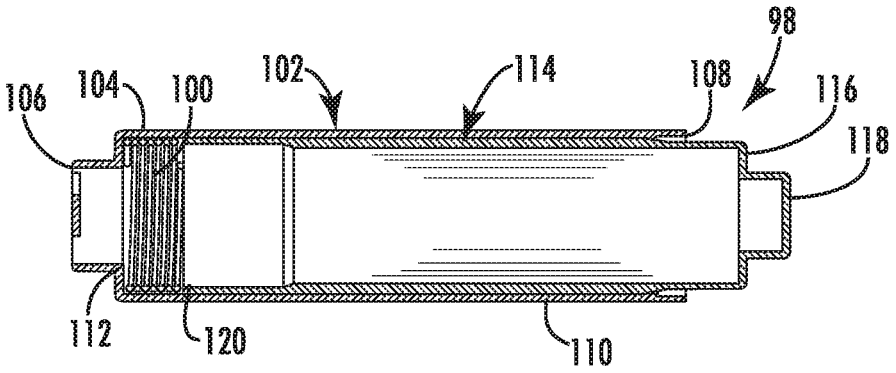
FIG. 14 is a cross section view of the spindle assembly of FIG. 10, illustrated in a collapsed position.
Figure 15:
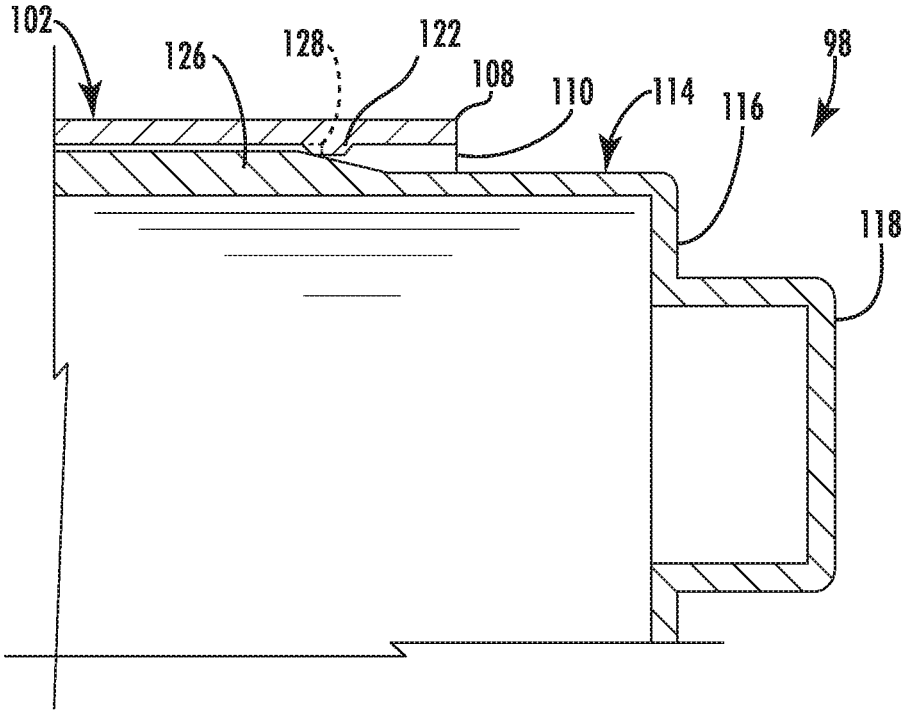
FIG. 15 is an enlarged partial cross section view of a portion of the spindle assembly of FIG. 10.

FIG. 14 is a cross-sectional view of the spindle assembly 98 in the compressed position wherein the longitudinal segments 126 engage inboard sides of the annular retainer segments 122 and are biased into engagement by the compressed coil spring 100. This engagement is illustrated enlarged in FIG. 15.

Figure 16:
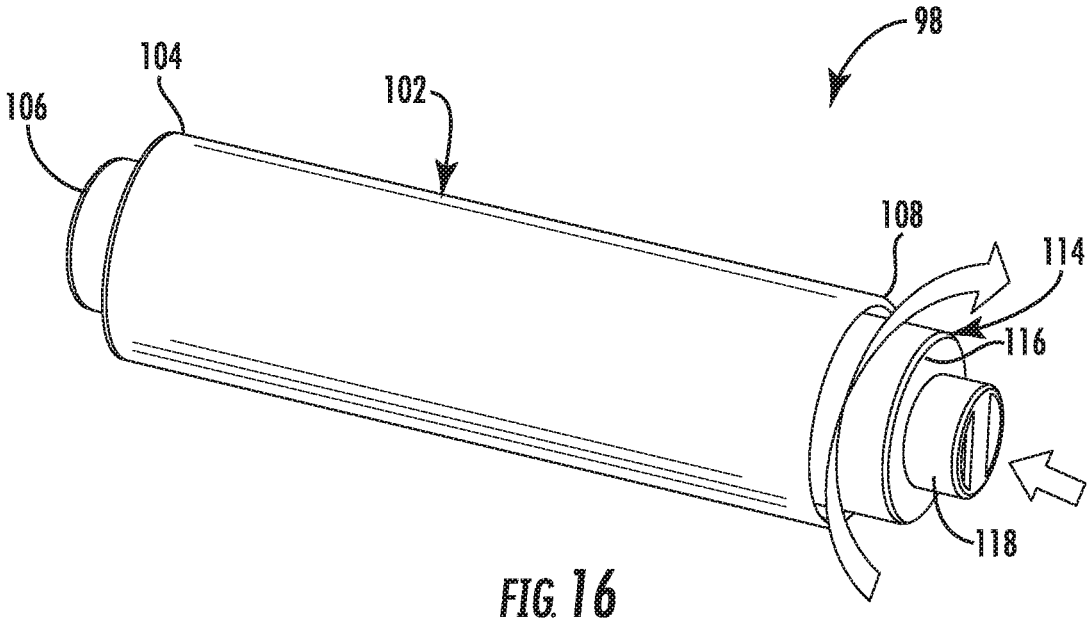
FIG. 16 is a perspective view of the spindle assembly of FIG. 10, illustrated in a collapsed position.
Figure 17:
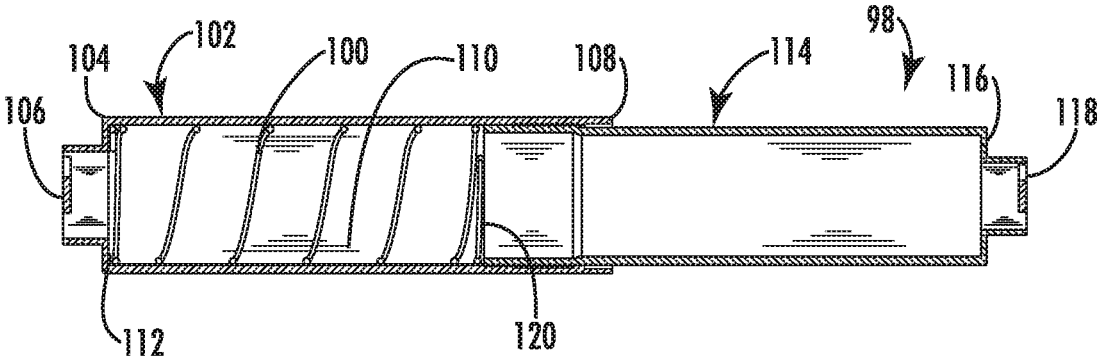
FIG. 17 is a cross section view of the spindle assembly of FIG. 10, illustrated in an expanded position.

FIG. 16 illustrates the manual input forces employed to expand the spindle assembly 98 from the fully compressed position. By pressing the inner spindle member 114 toward the outer spindle member 102, the coil spring 100 is further compressed and the longitudinal segments 126 are disengaged from the annular retainer segments 122. The inner spindle member 114 is rotated relative to the outer spindle member 102 to align the longitudinal segments 126 with the gaps 124 between the annular retainer segments 122. Once aligned, the inner spindle member 114 is translated relative to the outer spindle member 102 by the expansion of the coil spring 100 until the proximal end 120 engages the annular retainer segments 122 as illustrated in the expanded position of FIG. 17.

Referring again to FIG. 15, a plurality of detents 128 may be formed in the annular retainer segments 122, each sized to receive and nest one of the longitudinal segments 126. The detents 128 minimize inadvertent rotation of the inner spindle member 114 and consequently inadvertent expansion of the spindle assembly 98 during transport from vibration, handling or external forces or movement.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A packaged paper roll support assembly comprising:

a pair of brackets to mount to a support surface, each bracket having a receptacle formed therein;

a collapsible spindle with a pair of distal ends sized to be received in the pair of bracket receptacles to support a paper roll on the spindle;

a box with panels that define a cavity, wherein a pair of the panels are spaced apart to receive the collapsible spindle only in a collapsed state and disassembled from the pair of brackets, and wherein the box is sized to receive the pair of brackets; and a sheet sized to receive the collapsible spindle only in the collapsed state of the collapsible spindle, which is less than an overall length of the collapsible spindle, to retain the collapsible spindle in the collapsed state to minimize an overall size of the collapsible spindle in the collapsed state.

2. The packaged paper roll support assembly of claim 1 further comprising a flexible tie member cooperating with the pair of distal ends of the collapsible spindle to retain the collapsible spindle in the collapsed state.

3. The packaged paper roll support assembly of claim 1 wherein the collapsible spindle comprises:

an outer spindle member with one of the pair of distal ends of the collapsible spindle, an open end spaced apart from the distal end, a cavity formed within the outer spindle member with a first diameter, and a first retainer oriented within the cavity; and an inner spindle member with the other of the pair of distal ends of the collapsible spindle, a proximal end spaced apart from the distal end with an outer diameter sized to be received within the cavity for translation and rotation relative to the outer spindle, and a second retainer oriented on the inner spindle member in cooperation with the first retainer such that extension of the inner spindle member relative to the outer spindle is prevented in a first rotational orientation of the inner spindle member relative to the outer spindle member and extension of the inner spindle member relative to the outer spindle member is permitted in a second rotational orientation of the inner spindle member relative to the outer spindle member.

4. The packaged paper roll support assembly of claim 1 wherein the collapsible spindle comprises a pair of trunnions each oriented on one of the pair of distal ends that are each sized to be received in one of the pair of receptacles.

5. The packaged paper roll support assembly of claim 4 wherein the sheet is provided with a pair of spaced apart apertures sized to receive the pair of trunnions to retain the collapsible spindle in the collapsed state.

6. The packaged paper roll support assembly of claim 5 wherein the sheet is formed from a polymeric material.

7. The packaged paper roll support assembly of claim 3 further comprising a biasing member oriented within the cavity in cooperation with a blind depth of the cavity and the proximal end of the inner spindle member to bias the inner spindle member towards extension relative to the outer spindle member.

8. The packaged paper roll support assembly of claim 3 wherein the first retainer comprises an array of annular segments oriented in the cavity proximate to the open end, each spaced apart radially;

wherein the inner spindle member has a portion with a reduced diameter extending distally from the proximal end; and wherein the second retainer comprises an array of longitudinal extensions along the reduced diameter portion of the inner spindle member in cooperation with the array of annular segments in the first rotational orientation of the inner spindle member relative to the outer spindle member, and to align with spaces between the array of annular segments in the second rotational orientation of the inner spindle member relative to the outer spindle member.

9. The packaged paper roll support assembly of claim 8 wherein the array of annular segments comprises four annular segments; and wherein the array of longitudinal extensions comprises four longitudinal segments.

10. The packaged paper roll support assembly of claim 8 wherein a detent is formed in each of the array of annular segments facing the distal end of the outer spindle member, each detent sized to receive one of the array of longitudinal extensions to limit rotation of the inner spindle member relative to the outer spindle member.

11. The packaged paper roll support assembly of claim 1 wherein the collapsible spindle is collapsed at least thirty-three percent in the collapsed state relative to the overall length of the collapsible spindle.

12. The packaged paper roll support assembly of claim 1 wherein the sheet prevents distribution of a tensile load from the collapsible spindle in the collapsed state to the box.

13. The packaged paper roll support assembly of claim 12 wherein the box is formed from cardboard.

14. A packaged paper roll support assembly comprising:

a pair of brackets to mount to a support surface, each bracket having a receptacle formed therein;

a collapsible spindle with a pair of distal ends sized to be received in the pair of bracket receptacles to support a paper roll on the spindle;

a box with panels that define a cavity, wherein a pair of the panels are spaced apart to receive the collapsible spindle only in a collapsed state and disassembled from the pair of brackets, and wherein the box is sized to receive the pair of brackets; and a sheet sized to receive the collapsible spindle only in the collapsed state of the collapsible spindle, which is less than an overall length of the collapsible spindle, to retain the collapsible spindle in the collapsed state to minimize an overall size of the collapsible spindle in the collapsed state;

wherein the collapsible spindle comprises a pair of trunnions each oriented on one of the pair of distal ends that are each sized to be received in one of the pair of receptacles;

wherein the sheet is provided with a pair of spaced apart apertures sized to receive the pair of trunnions to retain the collapsible spindle in the collapsed state;

wherein the sheet is formed from a polymeric material;

wherein the collapsible spindle is collapsed at least thirty-three percent in the collapsed state relative to the overall length of the collapsible spindle;

wherein the sheet prevents distribution of a tensile load from the collapsible spindle in the collapsed state to the box; and wherein the box is formed from cardboard.

* * * * *